United States Patent [19]

Berg et al.

[11] Patent Number: 4,981,667

[45] Date of Patent: Jan. 1, 1991

[54] REMOVAL OF SULFUR FROM PETROLEUM COKE WITH LIME

[75] Inventors: Lloyd Berg, 1314 S. Third Ave., Bozeman, Mont. 59715; John W. Berg, Bozeman, Mont.

[73] Assignee: Lloyd Berg, Bozeman, Mont.

[21] Appl. No.: 508,422

[22] Filed: Apr. 13, 1990

[51] Int. Cl.[5] ..... B01J 8/00; C01B 17/00; F23J 11/00; F23J 15/00

[52] U.S. Cl. ..... 423/244; 110/345

[58] Field of Search ..... 423/244 A, 244 R; 110/345

[56] References Cited

U.S. PATENT DOCUMENTS 4,503,785 3/1985 Scocca ..... 110/345
4,517,165 5/1985 Moriarty ..... 423/244

FOREIGN PATENT DOCUMENTS 602166 7/1978 Switzerland ..... 423/244

*Primary Examiner*—Gregory A. Heller

[57] ABSTRACT

The sulfur in petroleum pitches and cokes can be converted to calcium sulfate instead of sulfur dioxide during combustion when calcium oxide or calcium carbonate is added to the molten pitch before burning.

2 Claims, No Drawings

REMOVAL OF SULFUR FROM PETROLEUM COKE WITH LIME

FIELD OF THE INVENTION

This invention relates to a method or process for converting the sulfur content of the flue gas from carbonaceous fuels into a solid by adding lime to the fuel before burning it.

DESCRIPTION OF THE PRIOR ART

The high carbon content fuels such as petroleum pitch, coal tar pitch and coke are among the cheapest source of energy. Their use is precluded however if they contain sulfur, 3% usually being the upper limit in most applications. When these sulfur containing materials are used for fuel, current restrictions on $SO_2$ in flue gas emission make it mandatory to employ scrubbers or some other method to remove the sulfur.

Berg, U.S. Pat. No. 4,687,647 described the use of high sulfur pitch in the conversion of molybdenite ores. Berg, U.S. Pat. No. 4,806,319 used high sulfur pitch to recover gaseous $SO_2$ and $NO_x$ from inert gases. In neither of these uses did the presence of the sulfur in the pitch have a deleterious effect on the process.

OBJECTIVE OF THE INVENTION

The obeject of this invention is to provide a method or process to convert the sulfur when present in pitches and cokes into a solid form when employed as a fuel.

SUMMARY OF THE INVENTION

The objects of this invention are provided by a process for converting the sulfur in pitches and cokes into a solid form by adding lime to the pitch or coke before combustion.

DETAILED DESCRIPTION OF THE INVENTION

We have discovered that when lime, either as calcium oxide or calcium carbonate, is added to molten high sulfur petroleum pitch, coal tar pitch or petroleum coke, when this mixture is burned in the usual manner, the lime reacts in the combustion zone to form solid calcium sulfate with the sulfur in the pitch. This comes out of the combustion zone as a fine solid powder much as ash does in a coal burner. We have also found that the molten pitch is a good conveyor of solid fuels such as fluid petrolem coke and sawdust and that the presence of CaO or $CaCO_3$ in the molten pitch will effectively combine with the sulfur these and convert it into solid $CaSO_4$. Petroleum pitch has a has a viscosity of about 350 Centistokes at 350° F., the temperature at which it should be heated in order to pump it into the furnace. We found that with coarse fluid petroleum coke, about 40% coke, 60% pitch was a mixture that could still be pumped. With dry sawdust, 25% sawdust, 75% pitch was pumpable. These ratios could be improved somewhat by grinding to a finer perticle size the fluid petroleum coke or the sawdust.

USEFULNESS OF THE INVENTION

High sulfur content petroleum pitches and cokes are precluded from commercial use as fuels because upon combustion, the sulfur is converted into gaseous sulfur dioxide, a compound with which it is prohibited to emit into the atmosphere. These pitches and cokes possess a high Btu content and are abundant and cheap. This invention employs lime mixed with the pitch to convert the sulfur to $CaS_4$ instead of $S_2$, a material which is a solid and is easily to dispose of or put to use. This invention presents an economically attractive way to employ high sulfur pitches and cokes, which are both high Btu content and low cost, as a fuel without introducing $SO_2$ into the flue gas.

WORKING EXAMPLES

Example 1

To 13 grams of pitch was added 1.2 grams of calcium oxide, CaO, and allowed to burn in air. The ash contained 3.95% sulfur.

Example 2

To 12 grams of pitch was added 1.9 grams of calcium carbonate, $CaCO_3$, and allowed to burn in air. The ash contained 4.2% sulfur.

Example 3

Twelve grams of pitch, eight grams fluid petroleum coke and 1.9 grams of $CaCO_3$ was mixed together and allowed to burn in air. The heating value of the mixture was 14,340 Btu/lb. and its sulfur content was 4.1%. The sulfur content of the ash was 8.0%.

Example 4

Seven grams of pitch, 2.5 grams of dry sawdust and 1.9 grams of $CaCO_3$ was mixed together and allowed to burn in air. The heating value of the mixture was 15,239 Btu/lb. and the sulfur content of the ash was 3.93%.

TABLE 1

Results of the Combustion of Pitch Mixtures

| Material | Btu/lb. | Calcium Compound Used | Sulfur Content Of Mixture, % | Ash Sulfur Content, % |
|---|---|---|---|---|
| Petroleum Pitch | 17,100 | CaO | 5 | 3.95 |
| Petroleum Pitch | 17,100 | $CaCO_3$ | 5 | 4.2 |
| Pitch + Fluid Coke | 14,340 | $CaCO_3$ | 6 | 4.1 |
| Pitch + Sawdust | 15,239 | $CaCO_3$ | 3.7 | 3.93 |

Table 1 summarizes the data obtained in the working examples.

We claim:

1. A method for burning a sulfur continuing molten carbonaceous material by adding sufficient calcium oxide or calcium carbonate to convert the sulfur content of the carbonaceous material to calcium sulfate during the burning, said carbonaceous material comprises petroleum pitch containing about 40 percent petroleum coke dissolved therein.

2. A method for burning a sulfur containing molten carbonaceous material by adding sufficient calcium oxide or calcium carbonate to convert the sulfur content of the carbonaceous material to calcium sulfate during the burning, said carbonaceous material comprises petroleum pitch containing about 25 percent sawdust dissolved therein.

* * * * *